US009428868B2

(12) United States Patent
Ewringmann et al.

(10) Patent No.: US 9,428,868 B2
(45) Date of Patent: Aug. 30, 2016

(54) TRAILER FOR A CHILDREN'S VEHICLE

(71) Applicants: Franz Schneider GmbH & Co. KG, Neustadt (DE); Ulrich Ewringmann, Taufkirchen (DE); Rainer Luther, Neustadt (DE)

(72) Inventors: Ulrich Ewringmann, Taufkirchen (DE); Rainer Luther, Neustadt (DE)

(73) Assignee: Franz Schneider GmbH & Co. KG, Neustadt (DE)

( * ) Notice: Subject to any disclaimer, the term of this patent is extended or adjusted under 35 U.S.C. 154(b) by 290 days.

(21) Appl. No.: 13/737,052

(22) Filed: Jan. 9, 2013

(65) Prior Publication Data

US 2013/0175370 A1 Jul. 11, 2013

(30) Foreign Application Priority Data

Jan. 11, 2012 (DE) ..... 10 2012 000 329
Feb. 16, 2012 (DE) ..... 20 2012 001 591 U

(51) Int. Cl.

| | |
|---|---|
| ***A01C 17/00*** | (2006.01) |
| ***E01C 19/20*** | (2006.01) |
| ***A63H 17/06*** | (2006.01) |
| ***A63H 17/26*** | (2006.01) |

(52) U.S. Cl.

CPC ..... *E01C 19/2025* (2013.01); *A63H 17/06* (2013.01); *A63H 17/266* (2013.01)

(58) Field of Classification Search

CPC ..... E01C 19/203; E01C 19/204; E01C 19/2025; A01C 17/00; A01C 17/001; A01C 17/005; A63H 17/266; A63H 17/06

USPC ..... 239/661, 668, 669, 681, 684, 685, 687, 239/688; 74/640, 575; 192/32, 56.61; 464/38, 39

See application file for complete search history.

(56) References Cited

U.S. PATENT DOCUMENTS

| | | | | |
|---|---|---|---|---|
| 1,828,370 | A * | 10/1931 | Huddle | F16D 7/044 464/39 |
| 4,062,203 | A * | 12/1977 | Leonard | B25B 23/141 464/38 |
| 4,106,704 | A * | 8/1978 | McRoskey et al. | 239/685 |
| 8,074,904 | B1 * | 12/2011 | Hobbs | 239/652 |
| 2002/0014545 | A1 * | 2/2002 | Woodruff et al. | 239/650 |
| 2003/0057303 | A1 * | 3/2003 | Thompson et al. | 239/663 |
| 2009/0277979 | A1 * | 11/2009 | Cichy et al. | 239/683 |

* cited by examiner

*Primary Examiner* — Jason Boeckmann
(74) *Attorney, Agent, or Firm* — Hammer & Associates, P.C.

(57) ABSTRACT

The trailer for a children's vehicle is characterized by a tub for accommodating spreading material, a drive casing on which the tub is positioned, a drive axle which is rotatably supported in the drive casing and is connected to a drive wheel, preferably a drive gear, for rotation therewith, a gearing, preferably a train of gears in the drive casing, which meshes with the drive wheel, and a spreading disc which is rotatably coupled with the gearing, wherein the tub comprises a bottom with an exit opening for the spreading material that is arranged above the spreading disc, so that exiting spreading material falls onto the spreading disc.

8 Claims, 8 Drawing Sheets

TRAILER FOR A CHILDREN'S VEHICLE

The present invention relates to a trailer for a children's vehicle. The children's vehicle may be a pedal vehicle, such as a tractor provided with a foot pedal, or, however, a children's vehicle provided with a motor.

It is the object of the present invention to indicate a trailer for a children's vehicle which has a high play value for children.

This object is achieved according to the invention by the features of claim 1.

Advantageous developments of the invention are characterized in the sub-claims.

The trailer of the invention comprises a tub for accommodating spreading material, e.g. sand or granulate of a grain size that is not too coarse. The tub is positioned on a drive casing in which a drive axle of the trailer is rotatably supported, the drive axle being connected to at least one of the two wheels seated on the axle so as to rotate therewith. The drive axle is thus rotated when the trailer is drawn by a children's vehicle.

A drive wheel, preferably a drive gear, which is connected to the drive axle for rotation therewith, is seated approximately in the center between the wheels of the trailer. This preferably provided drive gear meshes with a train of gears which consists of preferably five gears and the gears of which are arranged in the drive casing. Moreover, according to the invention a spreading disc is provided which preferably consists of a flat, horizontally arranged circular disc on the top side of which ribs are mounted in a star-shaped configuration, the spreading disc being rotatably coupled with the driven gear of the train of gears.

The spreading disc can also be coupled in a different way with the drive axle, e.g. via a chain or belt drive.

To avoid a possible risk of injury and damage to the spreading mechanism when the spreading disc is blocked while the driven gear is rotating, a ratchet mechanism is provided by which the spreading disc can be decoupled from the driven gear.

The tub of the trailer has a bottom with an exit opening for the spreading material which is arranged above the spreading disc, so that exiting spreading material falls onto the spreading disc.

In winter a child can e.g. protect an entrance which has been cleared of snow, but is icy and slippery, and which leads to a front door or to a sidewalk along a property, against the risk of slippage with the help of the trailer according to the invention in that the child allows spreading material to exit out of the tub of the trailer and distributes said material over the area traveled along with the children's vehicle. This playful occupation is not only interesting for children and is associated with a high play value, but it is also very useful under corresponding weather conditions.

The tub of the trailer consists preferably of plastics and is preferably produced in an injection molding process. The bottom of the tub is sloping in the position of use of the trailer on a horizontal area towards the exit opening, so that upon discharge of spreading material, sand or the like will always automatically and continuously be sliding towards the exit opening.

With great advantage it is provided that a slide is guided underneath the tub so as to be movable back and forth and the slide can close or release the exit opening. The slide is provided with a grip portion which is exposed at the drawbar side of the trailer, so that it can be easily gripped by a child sitting on the children's vehicle to close or release the exit opening of the tub, the discharged amount of spreading material being adjustable with a selected opening position.

The tub is provided with a removable or hinged cover, which has the advantage that in case of rainfall the spreading material remains in a dry state in the tub and does thus not clump together.

Ribs which are spaced apart from one another may be arranged or formed above the exit opening of the tub and form a kind of sieve, whereby the grain size of the spreading material falling out of the exit opening is limited. The free distance between the ribs is advantageously about 5 mm to 10 mm. This sieve, which may e.g. also be formed as a mesh, prevents a situation where the spreading disc positioned thereunder may get blocked by excessively coarse gravel, or the like.

The drive casing on which the tub is positioned is advantageously composed of a lower casing part, which may comprise fixed vertical shafts for supporting the gears of the preferably provided train of gears, of an upper cover of the lower casing part and of an upper casing part arranged thereabove, with the drive axle of the trailer being rotatably supported in the upper casing part. The individual parts of the drive casing may be locked and/or screwed together.

The spreading disc is expediently positioned above the cover and underneath an upper horizontal wall of the upper casing part which covers the spreading disc with an approximately semicircular contour and comprises a recess for the spreading material that is in alignment with the exit opening of the tub. The spreading disc which is preferably horizontal (in the horizontal position of use of the trailer) is connected to a vertical shaft which is coupled with the driven gear of the train of gears.

When the trailer is pulled by the children's vehicle, the rotation of the drive axle which is connected to a wheel or both wheels of the trailer for rotation therewith is transmitted to the gearing and from there to the spreading disc, whereby the spreading material falling thereon is radially ejected. To ensure that this will only take place towards the rearward portion of the trailer, the upper casing part comprises a downwardly bent circumferential wall which covers the rotating disc towards the front side, i.e. in the direction of the drawbar, and leaves it open towards the rear side of the tub in that a gap remains open between the circumferential wall and the spreading disc. The spreading material strikes forwardly against the circumferential wall that is enclosing the spreading disc with a minimum distance, and the material will remain positioned almost completely on the spreading disc until said disc has continued its rotation.

The tub is expediently locked and/or screwed to the drive casing which is also preferably made of plastics. The tub rests here in a stable state on supports laterally projecting from the drive casing.

It is further suggested that two spaced-apart U-shaped webs into which correspondingly shaped arms of a drawbar are preferably inserted in a form-fit manner should be arranged underneath the tub.

A flat transverse wall should extend between the two U-shaped webs at a distance from the bottom of the tub on which the slide is positioned that is guided between the U-shaped webs and in the recesses or slits of the drive casing.

The two wheels of the trailer, the gears, the drawbar and the slide are also preferably made of plastics without the invention being limited thereto.

Further details of the invention become apparent from the following description of a preferred embodiment and on the basis of the drawings, in which:

FIGS. 1A-1E are a perspective view, a rear view, a front view, a bottom view and a side view of the trailer;

Figure 1A:
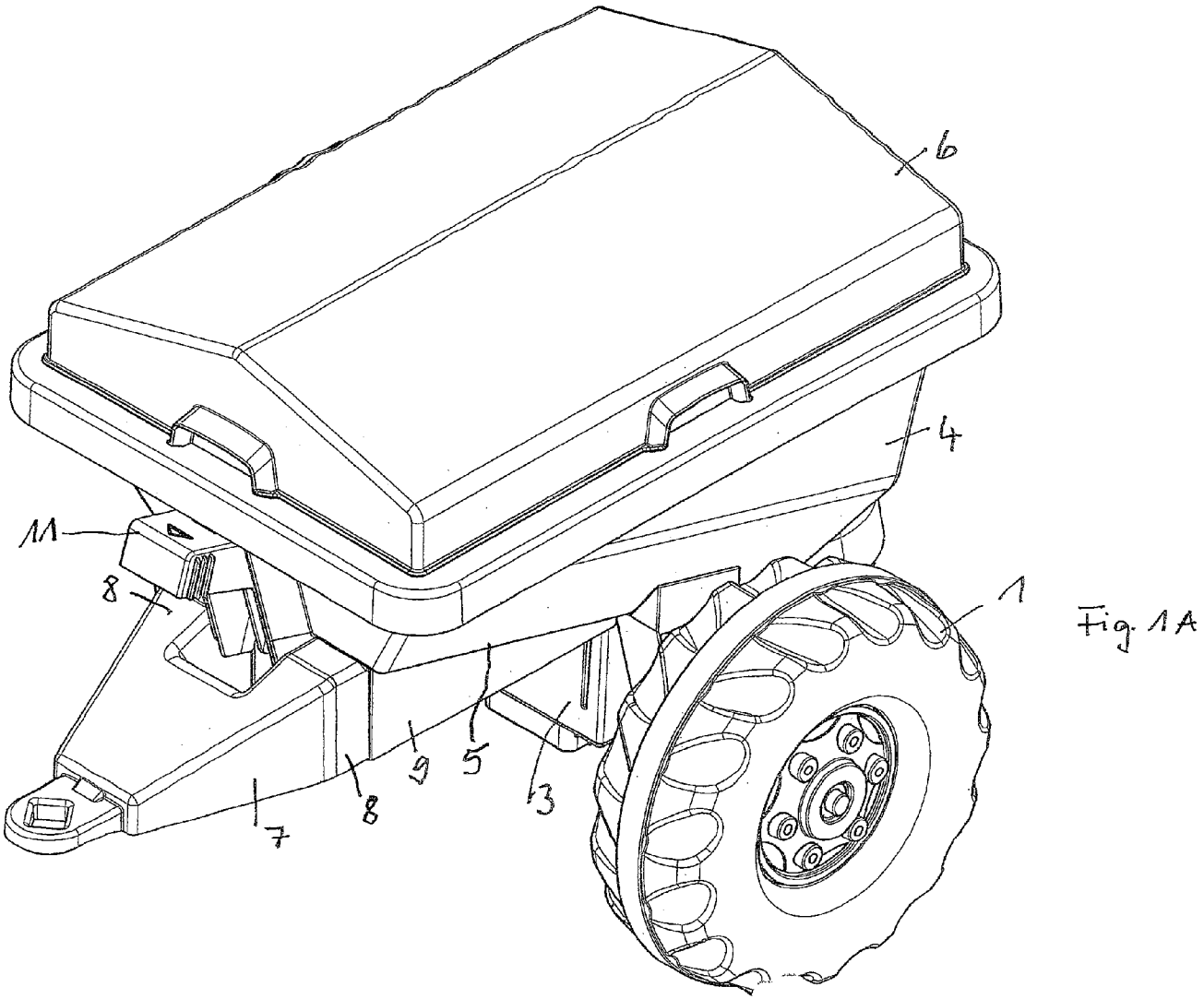
Figure 13:
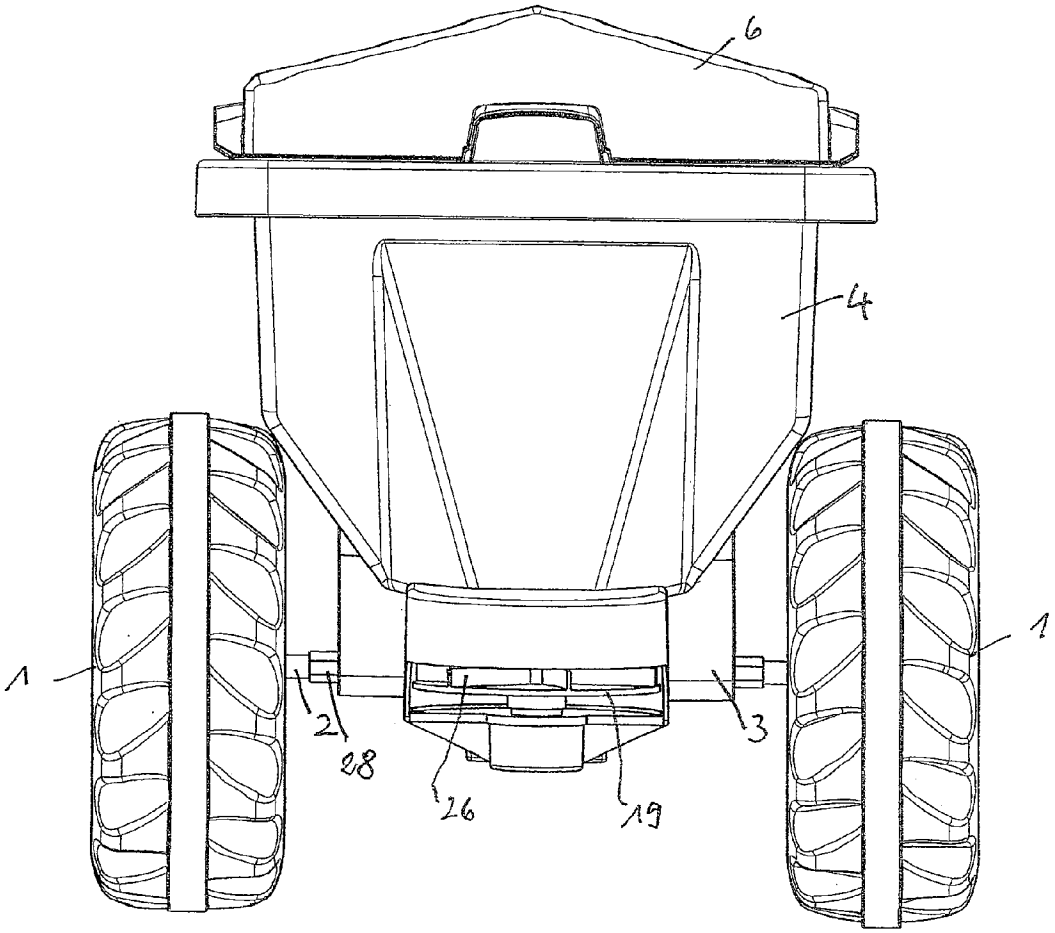
Figure 1C:
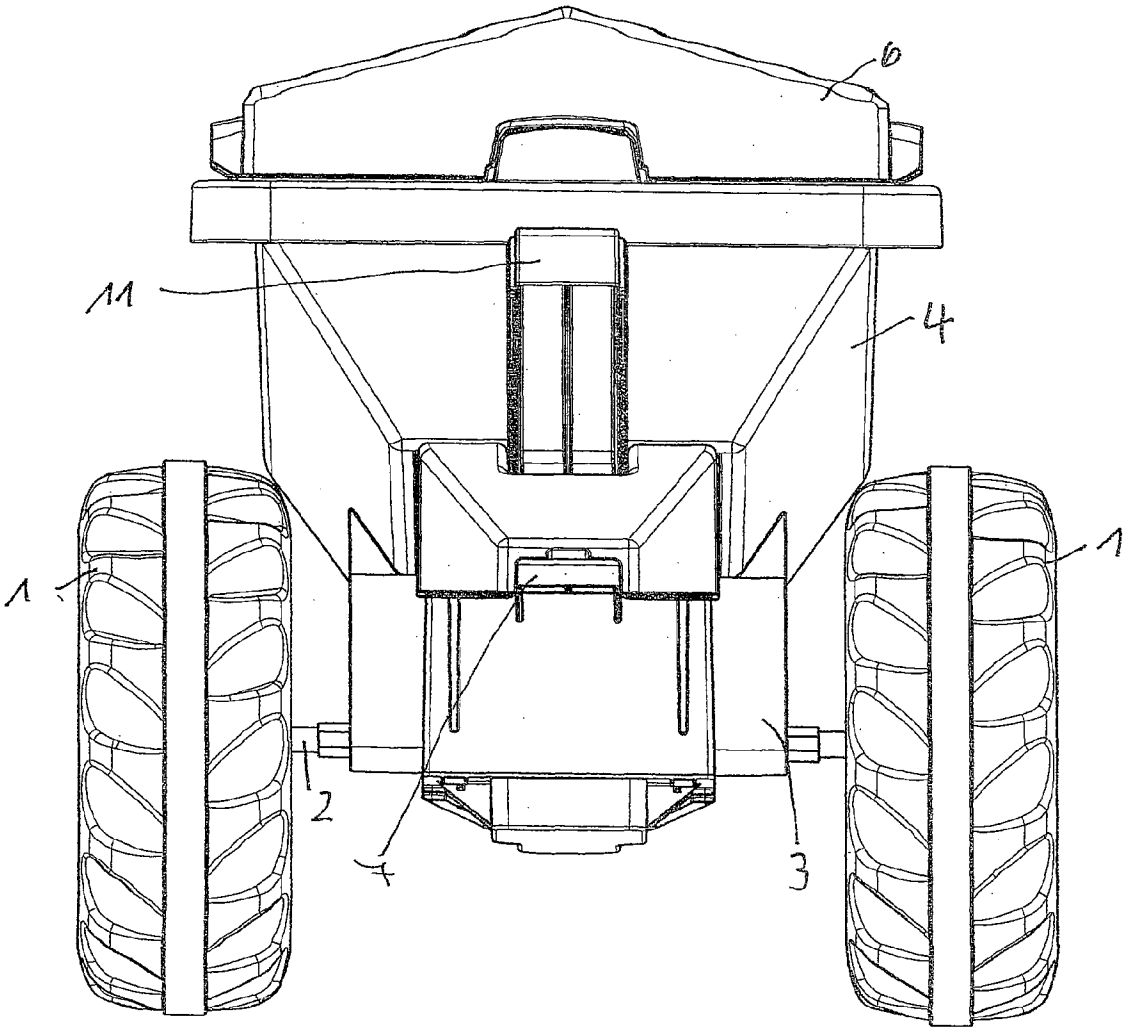
Figure 1D:
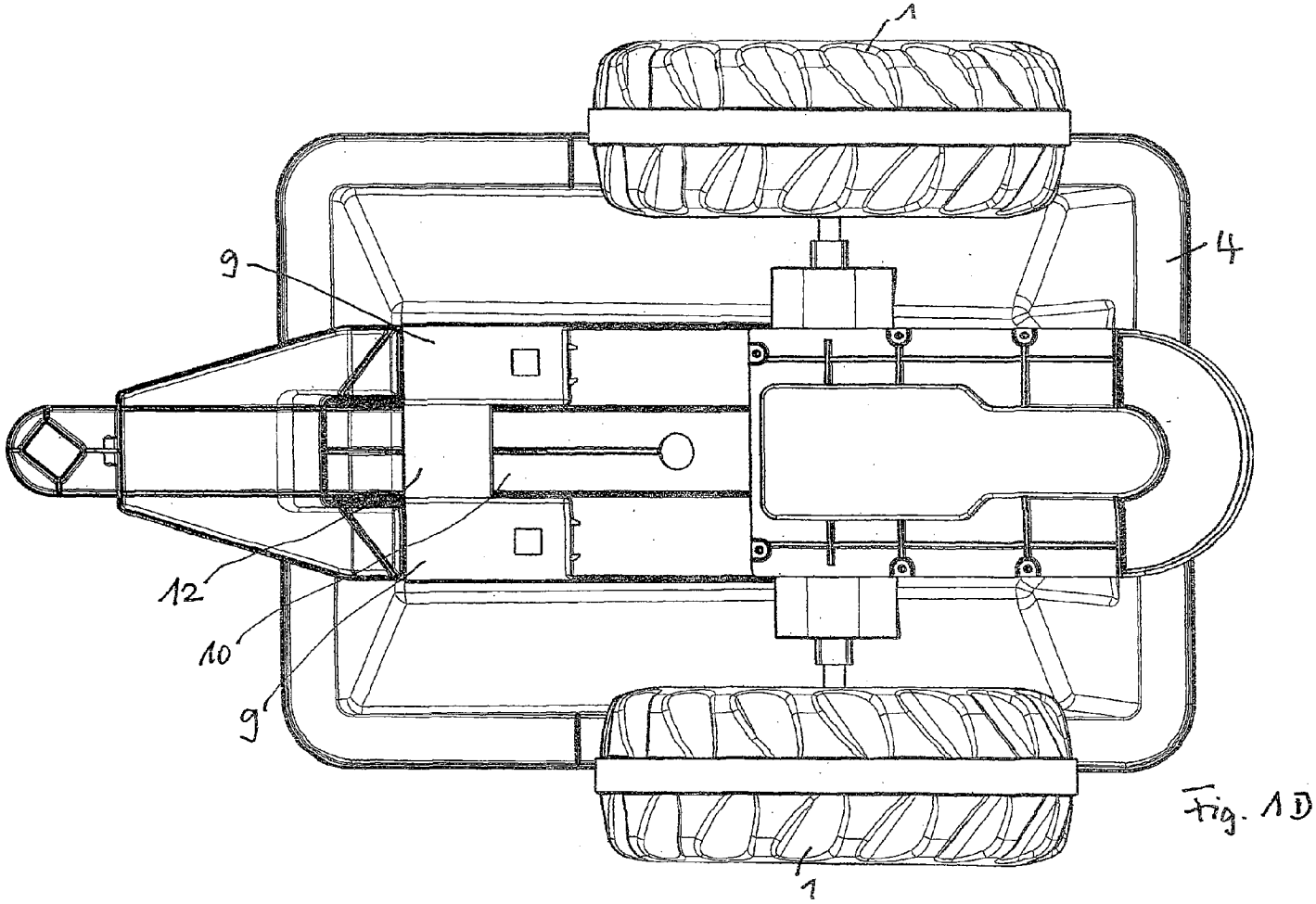
Figure 1E:
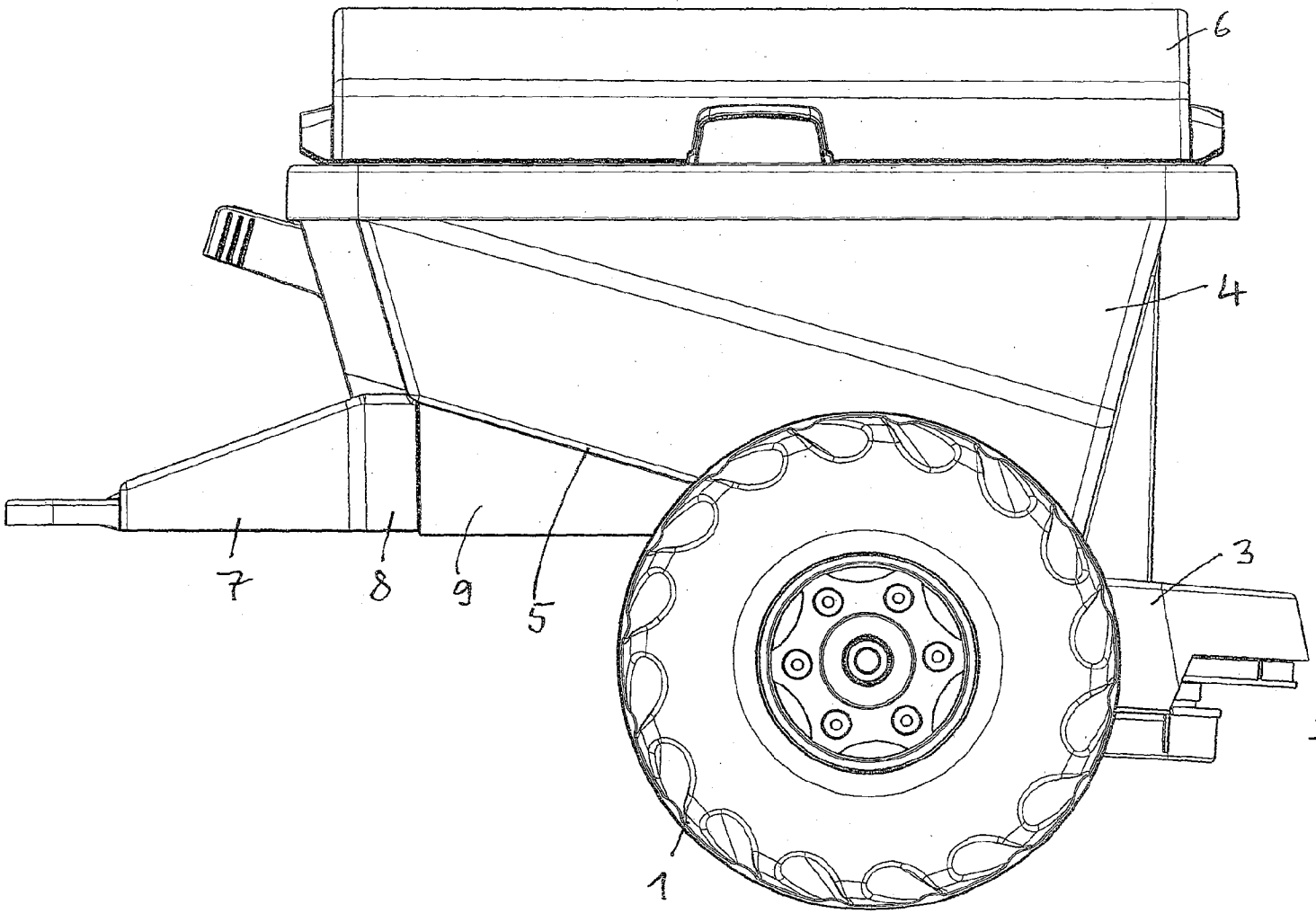

The trailer shown in FIGS. 1A-1E in different views comprises two wheels 1 seated on a drive axle 2, at least one wheel 1 being connected to the drive axle 2 for rotation therewith. The axle 2 is rotatably supported in a drive casing 3 to which a tub 4 is fastened. The tub 4 has a bottom 5 sloping obliquely towards the rear side of the trailer and is closed on its top side by a removable cover 6.

The tub 4 is connected to a drawbar 7 which can be coupled to a children's vehicle (not shown). The drawbar 7 comprises two laterally spaced-apart, substantially cubically shaped arms 8 that are inserted into two U-shaped webs 9 mounted on the bottom 5 of the tub 4.

A slide 10 is arranged between the two arms 8 of the drawbar 7 closely underneath the bottom 5 of the tub 4 and is provided with a bent hand grip 11 which is easily gripped by a child sitting on a vehicle and is supported to be movable back and forth. A transverse wall 12 on which the slide 10 is seated is formed between the U-shaped webs 9 at a distance underneath the bottom 5 of the tub 4.

Figure 2:
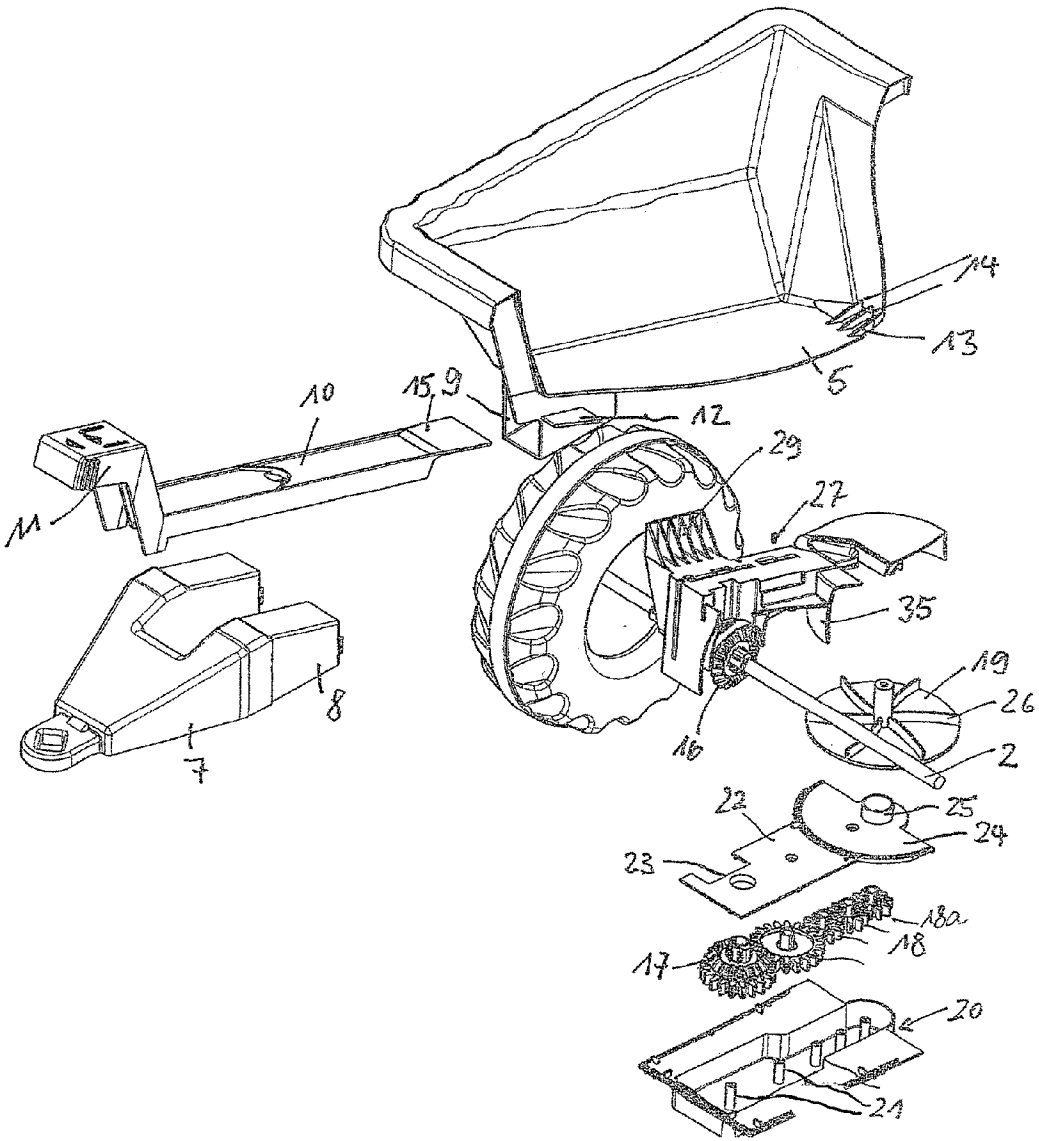
FIG. 2 is an exploded view of the essential parts of the trailer, partly in section.
Figure 3:
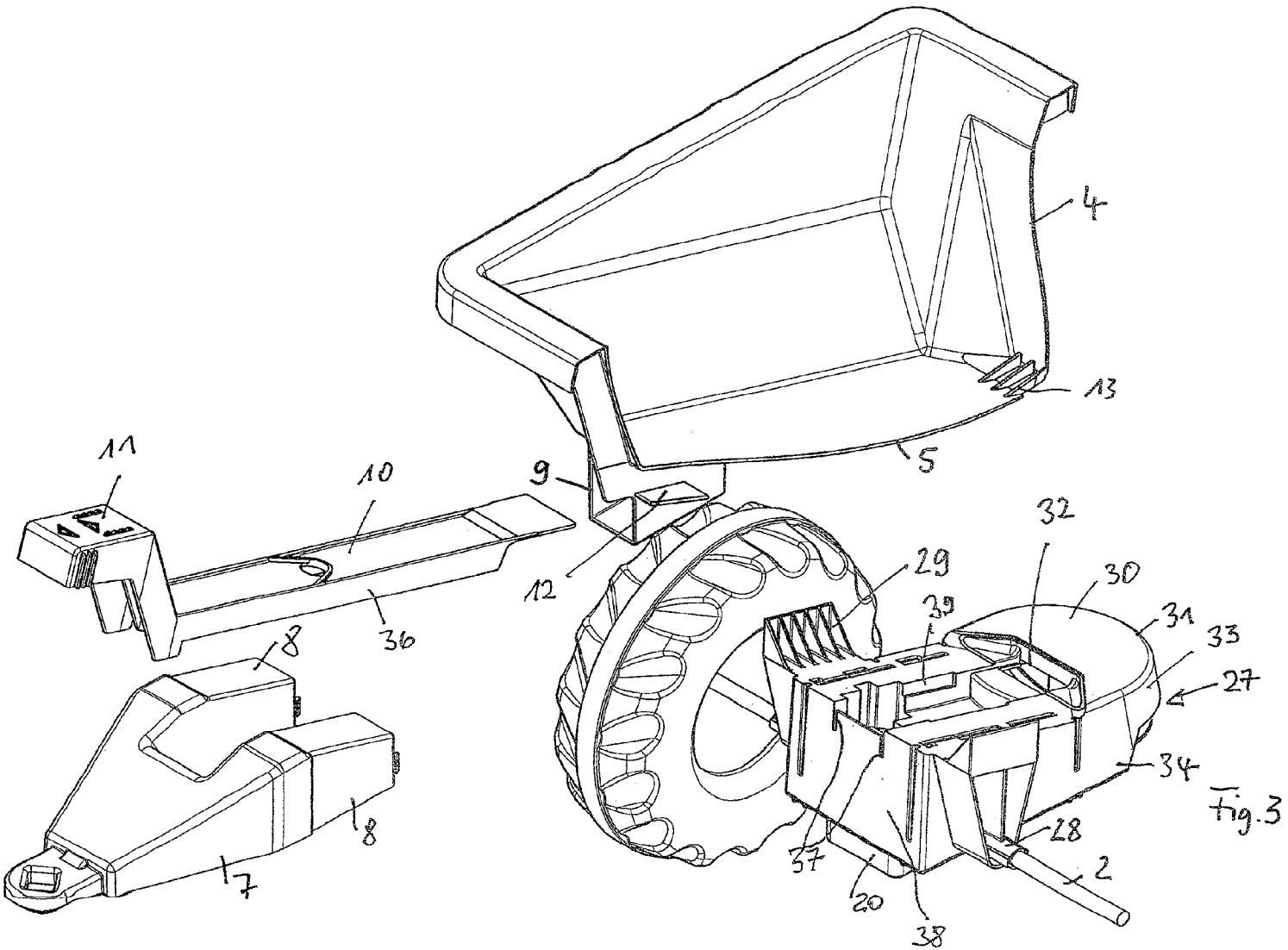
FIG. 3 is a similar view as in FIG. 2, but with a composite drive casing.
Figure 4:
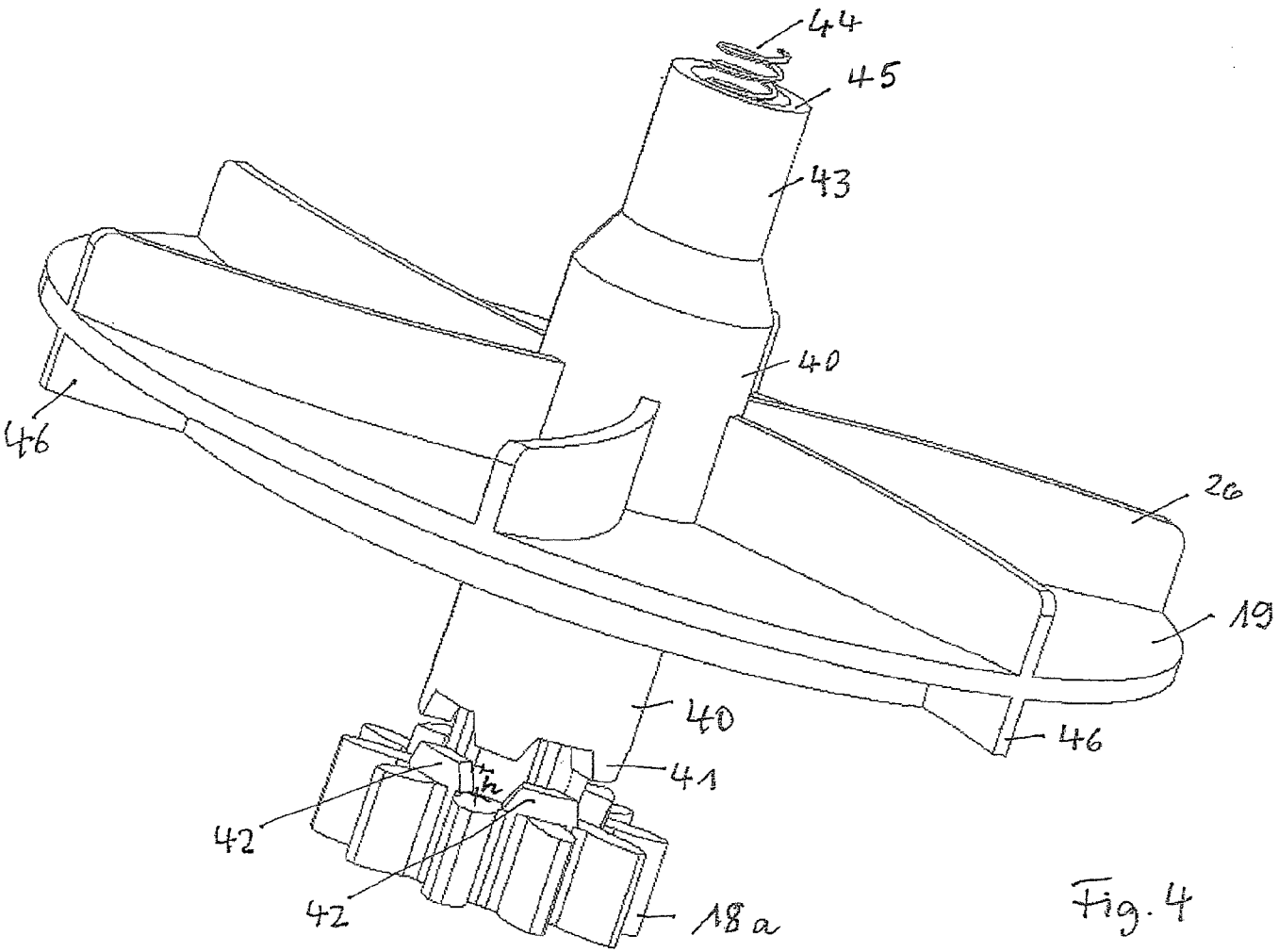
FIG. 4 shows the driven gear and the spreading disc for illustrating the ratchet function thereof.

As shown in FIGS. 2 and 3, the bottom 5 is provided on its rear edge with an exit opening 13 for spreading material (not shown) accommodated in the tub 4. The exit opening 13 is covered by parallel ribs 14 which have a distance of about 10 mm from one another and serve as a sieve for the exiting spreading material.

The sieve 10 extends such that its end section 15 facing away from the hand grip 11 is closely positioned underneath the exit opening and closes said opening when the slide 10 is in the pushed-in end position. When the slide 10 is pulled on its hand grip 11 towards the drawbar 7, the exit opening 13 is more and more released.

As can be seen in FIG. 2, the drive axle 2 has seated thereon a bevel gear 16 approximately in the center of the drive axle 2, the bevel gear being connected to the drive axle 2 for rotation therewith. The bevel gear is meshing with a bevel gear 17 of a train of gears that additionally includes four further intermeshing gears 18 so as to form a train of gears with which a spreading disc 19 can be rotated. The gears 17, 18 are arranged in a lower casing part 20 that comprises vertical shaft stubs 21 for supporting the gears.

The gears are covered by a cover 22 of the lower casing part 20, the cover including a recess 23 through which the bevel gear 16 gets into engagement with the bevel gear 17. The cover 22 has an approximately semicircular section 24 with a short tubular section 25 through which a shaft of the spreading disc 19 arranged thereon is coupled with the driven gear 18*a*.

This shaft is formed by a tubular attachment 40 which is mounted or formed on the spreading disc 19 for rotation therewith and extends from the spreading disc 19 upwards and downwards. The lower end section of the tubular attachment 40 has formed thereon teeth 41 with inclined flanks that engage into corresponding teeth 42 formed on the top side of the driven gear 18*a*. The upwardly extending part of the tubular attachment 40 is tapering towards a tubular section 43 in which a coil spring 44 is inserted that is supported with its lower end in the tubular section and projects beyond the edge 45 of the tubular section 43.

The spreading disc 19 is guided with the lower part of the tubular attachment 40 in the tubular section 25 of the cover 22, and the spring 44 is supported on the bottom side of the wall 30 of the upper casing part 27, with a distance that is greater than the height h of the teeth 41 and 42 remaining between the edge 45 of the tubular section 43 and the wall 30 of the casing part 27. A ratchet mechanism is thereby formed that makes it possible to drivingly disconnect the spreading disc 19 from the rotating driven gear 18*a* if the gear is e.g. blocked by a finger of a playing person or by spreading material that is too coarse-grained; in this case the teeth 41 will slide upwards along the inclined flanks of the teeth 42 against the force of a spring. This prevents a possible risk of injury as well as damage to the spreading mechanism.

The tubular section 43 can be guided in a tubular lower attachment of the upper casing part 27.

Six, slightly bent ribs 25 that are substantially arranged in a star-shaped configuration and extend up to the tubular attachment 40 are formed on the top side of the spreading disc 19. Three short ribs 46 are formed on the bottom side of the spreading disc 19 and prevent spreading material from collecting on the semicircular section 24 and from blocking the spreading disc 19.

The lower casing part 20 and the cover 22 are fastened, preferably screwed, to an upper casing part 27. The drive axle 2 is rotatably supported in sleeve-like sections 28 of the upper casing part 27. The upper casing part 27 comprises laterally projecting, obliquely upwardly oriented supports 29 for the tub 4 that is positioned on the top side of the upper casing part 27 and is additionally screwed and/or locked to the upper casing part 27. The upper casing part 27 comprises an upper wall 30 with an approximately semicircular contour 31 which covers the spreading disc 19. The upper wall 30 has formed therein an opening 32 which is in alignment with the exit opening 13 in the tub bottom 5, so that exiting spreading material falls through the opening 32 onto the spreading disc 19 arranged thereunder. The wall 30 has a downwardly bent circumferential wall 33 and 34. The wall section 33 ends at some distance above the spreading disc 19, so that spreading material can be ejected towards the rear side of the trailer. The circumferential wall 34 extends further downwards. As shown in FIG. 2, an inner circumferential wall 35 extends approximately around the front half of the spreading disc 19 and prevents spreading material from being ejected in that direction from the spreading disc 19. To this end the circumferential wall 35 has an only minimal distance from the edge of the spreading disc 19.

The slide 10 is guided with bent sidewalls 36 in slits 37 in the front face wall 38 and on guide surfaces 39 on the top side of the upper casing part 27.

The invention claim is:

1. A trailer for a children's vehicle comprises:

a tub for accommodating spreading material, a drive casing on which the tub is positioned, a drive axle rotatably supported in the drive casing and connected to a drive wheel for rotation therewith, a gearing in the drive casing meshes with the drive wheel, a spreading disc rotatably coupled with the gearing, and a ratchet mechanism connecting the spreading disk and the gearing, so that when the spreading disc is blocked, the spreading disc is disconnected from the gearing, the ratchet mechanism including a spring and a plurality of intermeshing upper teeth and lower teeth, each tooth having two lateral slanted sides, the tub includes a bottom with an exit opening for the spreading material, and the exit opening is arranged above the spreading disc, so that exiting spreading material falls onto the spreading disc, two U-shaped webs mounted on the bottom of the tub, a flat transverse wall extending between the U-shaped webs at a distance underneath the bottom of the tub, and a drawbar coupleable to the children's vehicle, the drawbar includes two substantially cubic arms that are insertable into the two U-shaped webs on the bottom of the tub, and a slide positioned between the U-shaped arms and seated on the flat transverse wall and closely positioned underneath the bottom of the tub, the slide is moveable back and forth and closes or releases the exit opening in a dosed manner, the slide includes a bent-up grip projecting from a front of the tub, so the grip is easily gripped by the child seated on the vehicle.

2. The trailer for a children's vehicle according to claim 1 wherein the bottom of the tub slopes obliquely downwards to the exit opening.

3. The trailer for a children's vehicle according to claim 1 wherein the drive casing includes a lower casing part, a cover for the lower casing part, and an upper casing part, the lower casing part includes a fixed shaft supporting the gearing, the upper casing part rotatably supports the drive axle.

4. The trailer for a children's vehicle according to claim 3 wherein the spreading disc is arranged above the cover and below a wall of the upper casing part, the wall includes a recess for the spreading material.

5. The trailer for a children's vehicle according to claim 4 wherein the upper casing part comprises a downwardly bent circumferential wall covering the spreading disc towards the drive axle and leaves the drive axle open towards a rear side of the tub.

6. The trailer for a children's vehicle according to claim 1 wherein the tub is locked and/or screwed to the drive casing.

7. The trailer for a children's vehicle according to claim 1 wherein spaced-apart ribs are arranged above the exit opening of the tub.

8. The trailer for a children's vehicle according to claim 7 wherein the ribs, which are substantially arranged in a star-shaped configuration, are mounted on a top side and a bottom side of the spreading disc.

* * * * *